US008726870B2

(12) United States Patent
Cronin

(10) Patent No.: US 8,726,870 B2
(45) Date of Patent: May 20, 2014

(54) ROTATIONAL ENERGY HEAT GENERATION APPARATUS AND METHODS

(76) Inventor: Patrick M. Cronin, Fargo, ND (US)

( * ) Notice: Subject to any disclaimer, the term of this patent is extended or adjusted under 35 U.S.C. 154(b) by 0 days.

(21) Appl. No.: 13/452,992

(22) Filed: Apr. 23, 2012

(65) Prior Publication Data

US 2012/0210953 A1 Aug. 23, 2012

Related U.S. Application Data

(63) Continuation of application No. PCT/US2011/027457, filed on Mar. 7, 2011.

(60) Provisional application No. 61/311,379, filed on Mar. 7, 2010.

(51) Int. Cl.
*B60H 1/02* (2006.01)
*F01P 5/14* (2006.01)

(52) U.S. Cl.
USPC ..... 123/142.5 R; 123/41.15; 237/12.3 R

(58) Field of Classification Search
USPC ..... 123/142.5 R, 41.15; 237/12.3 R
See application file for complete search history.

(56) References Cited

U.S. PATENT DOCUMENTS

| | | | | |
|---|---|---|---|---|
| 1,915,547 | A * | 6/1933 | North et al. | 188/274 |
| 2,827,133 | A * | 3/1958 | Schneider | 188/274 |
| 2,889,013 | A * | 6/1959 | Schneider | 188/274 |
| 3,720,372 | A * | 3/1973 | Jacobs | 237/12.3 B |
| 3,945,473 | A * | 3/1976 | Prather et al. | 188/296 |
| 4,388,915 | A | 6/1983 | Shafran | |
| 4,733,635 | A | 3/1988 | Menard | |
| 5,573,184 | A | 11/1996 | Martin | |
| 5,775,583 | A | 7/1998 | Braatz | |
| 6,039,007 | A | 3/2000 | Ban | |
| 8,302,876 | B2 * | 11/2012 | Sanger et al. | 237/12.3 R |
| 2009/0235914 | A1 | 9/2009 | Derman | |

FOREIGN PATENT DOCUMENTS

| | | | |
|---|---|---|---|
| KR | 10-2006-0115302 | A | 11/2006 |
| KR | 10-2009-0041579 | A | 4/2009 |

OTHER PUBLICATIONS

PCT/US2011/027457 International Search Report and Written Opinion, related to instant application.

* cited by examiner

*Primary Examiner* — Noah Kamen
(74) *Attorney, Agent, or Firm* — Paul J Fordenbacher, Esq.

(57) ABSTRACT

A hydrodynamic heater is provided having a rotational member and a stationary member. The rotational member is operable to rotate relative to the stationary member about an axis so as to induce fluid shear and therefore, thermal energy to the working fluid. The hydrodynamic heater may be a component of a heat generation system comprising an internal combustion engine having a drive shaft for rotating the rotational member of the hydrodynamic heater. The heat generated by the hydrodynamic heater, as well as the heat generated by the engine from the engine exhaust and engine cooling system, is combined to heat a working fluid.

6 Claims, 11 Drawing Sheets

ROTATIONAL ENERGY HEAT GENERATION APPARATUS AND METHODS

RELATED APPLICATIONS

This application is a non-provisional application claiming the benefit of U.S. Provisional Application No. 61/311,379, filed Mar. 7, 2010, incorporated herein in its entirety by reference, and this is a continuation application claiming the benefit of PCT Application No. PCT/US2011/027457, filed Mar. 7, 2011, incorporated herein in its entirety by reference.

FIELD

The present subject matter is related to devices for the production of heat, and more particularly, to methods and apparatus for generating heat using rotational energy.

BACKGROUND

A hydrodynamic heater generates heat by inducing shear within a fluid. The shear may come in the form of structure that is caused to move within the fluid. Heat may be generated by a principle known as fluid resistance heating, in affect, friction heating. Heating may also be generated by a principle of direct cavitation within layers of liquid. Although the transformation of mechanical energy into thermal energy via the hydrodynamic heater is relatively efficient, an increase in energy efficiency is desirable.

BRIEF DESCRIPTION OF THE DRAWINGS

Like reference numbers generally indicate corresponding elements in the figures.

DETAILED DESCRIPTION

Figure 1:
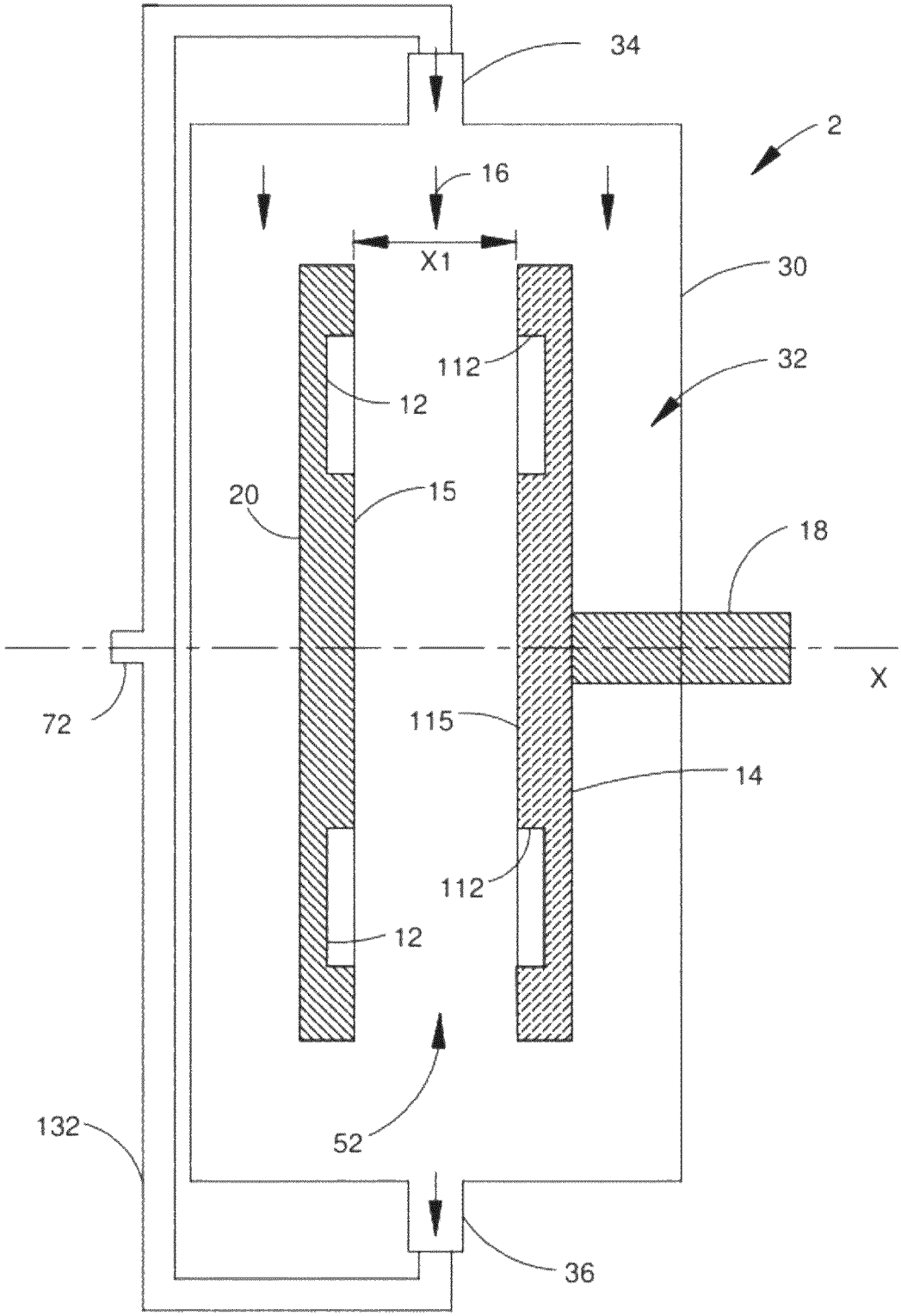
FIG. 1 is a side cross-sectional view of an embodiment of a hydrodynamic heater in accordance with an embodiment.

In the following description, embodiments of apparatus and methods will be disclosed. For purposes of explanation, specific numbers, materials, or configurations are set forth in order to provide a thorough understanding of the embodiments. However, it will also be apparent to those skilled in the art that the embodiments may be practiced without one or more of the specific details, or with other approaches, materials, components, etc. In other instances, well-known structures, materials, or operations are not shown or described in detail to avoid obscuring the embodiments. Accordingly, in some instances, features are omitted or simplified in order to not obscure the disclosed embodiments. Furthermore, it is understood that the embodiments shown in the figures are illustrative representations and are not necessarily drawn to scale.

Reference throughout this specification to "one embodiment" or "an embodiment" means that a particular feature, structure, or characteristic described in connection with the embodiment is included in at least one embodiment of claimed subject matter. Thus, the appearances of the phrase "in one embodiment" or "an embodiment" in various places throughout this specification are not necessarily all referring to the same embodiment. Furthermore, the particular features, structures, or characteristics may be combined in one or more embodiments.

Reference will now be made to embodiments illustrated in the drawings and specific language which will be used to describe the same. It will nevertheless be understood that no limitation of the scope of the invention is thereby intended. Alterations and further modifications of the illustrated embodiments and further applications of the principles of the invention, as would normally occur to one skilled in the art to which the invention relates, are also within the scope of the invention.

FIG. 1 is a side cross-sectional view of an embodiment of a hydrodynamic heater 2 in accordance with an embodiment. The hydrodynamic heater 2 comprises a stationary member 20 and a rotation member 14 disposed proximate the stationary member 20 with a working fluid therebetween. Rotation of the rotation member 14 about an X-axis induces fluid shearing and fluid friction within the working fluid operable to increase the temperature of the working fluid.

Figure 2:
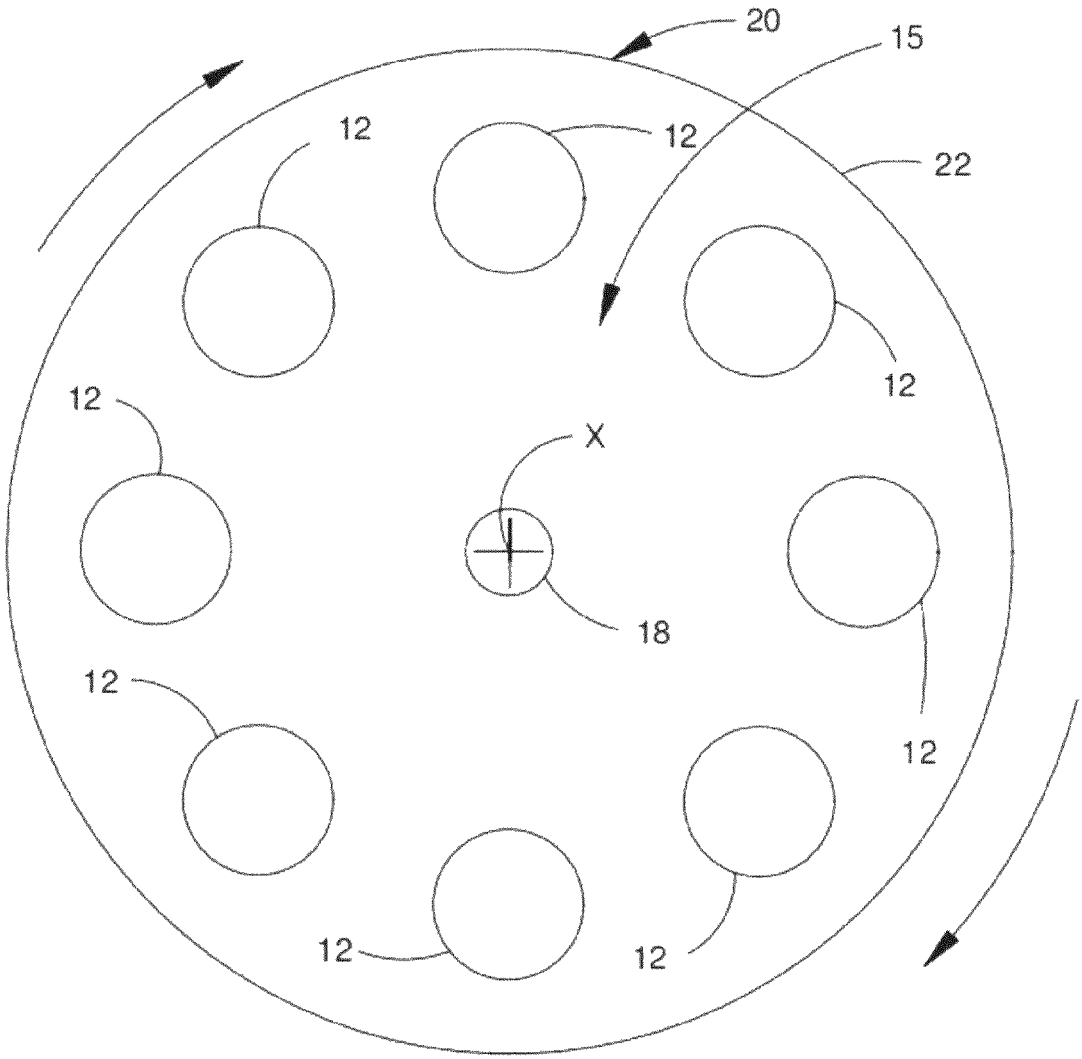
FIG. 2 is a front view of the stationary member of FIG. 1.

FIG. 2 is a front view of the stationary member 20 of the embodiment of FIG. 1. The stationary member 20 comprises a first disk-shaped member 22 having a plurality of fluid interactive elements 12. The plurality of fluid interactive elements 12 are disposed and arranged in a planar, generally circular, spaced-apart, orientation on the first disk-shaped member 22 defining a fluid interactive disk face 15, also shown in FIG. 1. The first disk-shaped member 22 defines an X-axis which is substantially perpendicular to the fluid interactive disk face 15.

Figure 3:
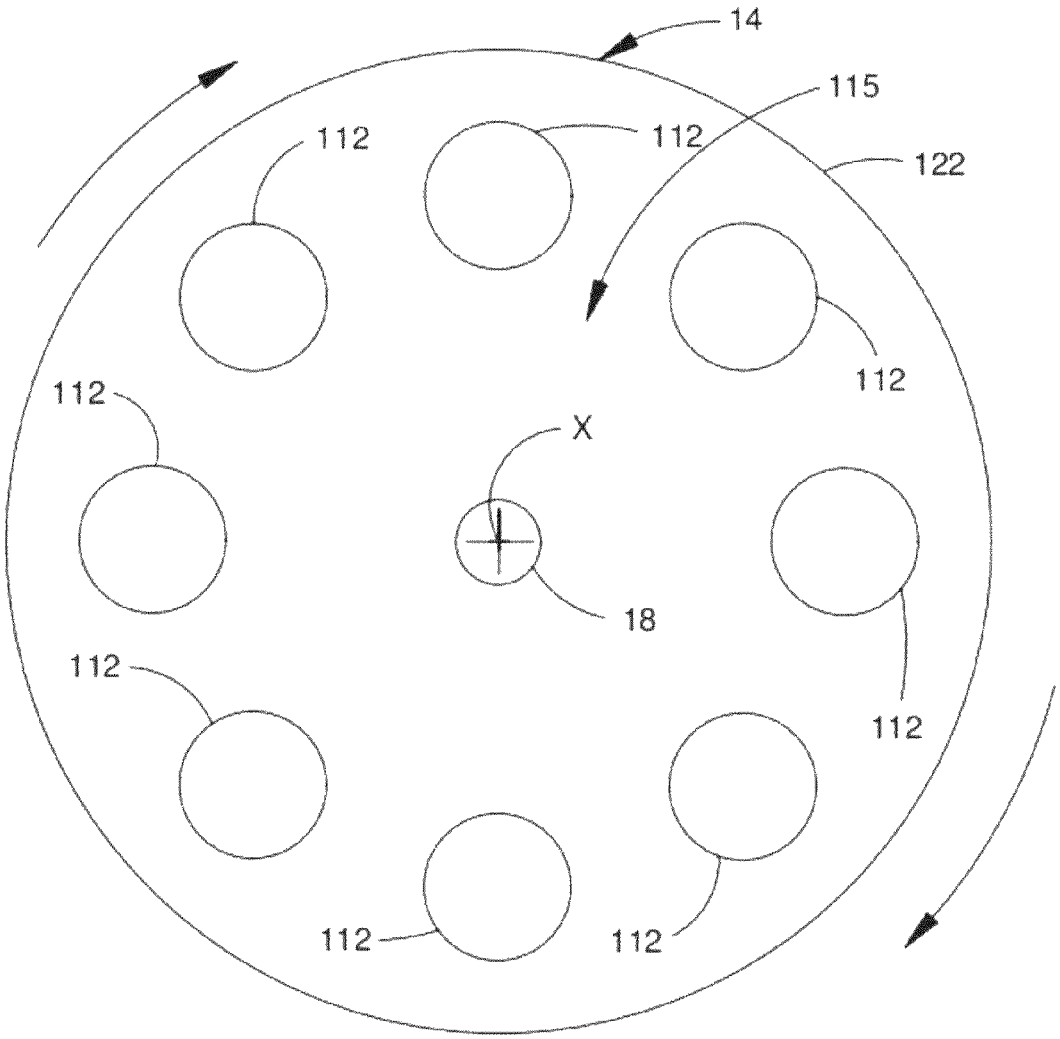
FIG. 3 is a front view of the rotation member of the embodiment of FIG. 1.

FIG. 3 is a front view of the rotation member 14 of the embodiment of FIG. 1. The rotation member 14 comprises a second disk-shaped member 122 having a plurality of fluid driver elements 112 and a shaft 18. The plurality of fluid driver elements 112 are disposed and arranged in a planar, generally circular, spaced-apart, orientation on the second disk-shaped member 122 defining a fluid driver disk face 115, also shown in FIG. 1. The shaft 18 is coupled substantially at the center of rotation of the disk-shaped member 122. The center of rotation of the disk-shaped member 122 defines an X-axis which is substantially perpendicular to the fluid driver disk face 115.

The shaft 18 is operable to couple with an energy source operable for imparting rotation to the shaft 18 so as to rotate the rotation member 14 about the X-axis. Examples of a suitable energy source include, but are not limited to, an electric motor, hydraulic pump, and internal combustion engine using a drive shaft, power take-off, or belt drive, among others.

Referring again to FIG. 1, the fluid driver disk face 115 of the rotation member 14 is disposed in opposing, substantially parallel, spaced-apart relationship and substantially coaxial with the fluid interactive disk face 15 of the stationary member 20 along the X-axis. The distance of separation between the fluid driver disk face 115 and the fluid interactive disk face 15 is designated as spacing X1 in FIG. 1. The space between and defined by the fluid driver disk face 115 and the fluid interactive disk face 15 is referred herein as the fluid interaction space 52. Substantially all of the heating of the fluid due to the interaction of the fluid driver elements 112 of the rotation member 14 and the fluid interactive elements 12 of the stationary member 20 with the fluid occurs within the fluid interaction space 52.

As the shaft 18 is rotated, the fluid driver elements 112 of the rotation member 14 move relative to the fluid interactive elements 12 of the stationary member 20. Fluid disposed between the fluid driver disk face 115 and the fluid interactive disk face 15 in the fluid interaction space 52 is acted upon hydrodynamically so as to induce heating therein. Fluid shear and friction causes the temperature of the working fluid to increase.

The hydrodynamic heater 2 also comprises a housing 30 defining a fluid cavity 32 into which the stationary member 20 and the rotation member 14 are disposed. The housing 30 defines a fluid inlet 34 and a fluid outlet 36 operable to provide fluid ingress and egress, respectively. The flow of working fluid is substantially from the fluid inlet 34, through the space between the fluid driver disk face 115 and the fluid interactive disk face 15 and out through the fluid outlet 36. The working fluid may be driven through the housing 30 by an external pump (not shown) in accordance with an embodiment or by the movement of the fluid driver elements 112 in accordance with another embodiment, but not limited thereto.

It is appreciated that the stationary member 20 may comprise one or more fluid interactive elements 12. The fluid interactive elements 12 are operable to cooperate with the one or more fluid driver elements 112 so as to induce fluid shear operable to heat the fluid therebetween. The fluid interactive elements 12 and the fluid driver elements 112, as provided in the embodiment of FIG. 1, are concave by way of example. In other embodiments, the fluid interactive elements 12 and the fluid driver elements 112 are convex or fan-blade shaped suitable for the particular purpose. The fluid interactive elements 12 and the fluid driver elements 112 may be substantially similar in shape or may be of different shapes.

One fluid driver element 112 may be sufficient to induce the necessary fluid movement to provide shearing that creates friction heating of the working fluid. It is appreciated that when reference is made to a plurality of fluid driver elements 112, it applies also to embodiments comprising one fluid driver element 112.

The amount of fluid shear, and thus the amount of heating of the fluid induced by the rotation of the fluid driver elements 112, is determined, at least in part, by one or more of the speed of rotation of the rotation member 14, the spacing X1 which is the distance of separation between the fluid driver disk face 115 and the fluid interactive disk face 15, and the speed of the working fluid into and out of the fluid inlet 34 and the fluid outlet 36, respectively. The properties of the working fluid also determine, at least in part, the degree of heat induced by the fluid movement. The properties of the fluid include, but are not limited to, density, viscosity, and heat capacity, among others.

It is appreciated that heat output of the hydrodynamic heater 2 may also depend on the size of the apparatus, such as, but not limited to the diameter of the fluid driver disk face 115 and the fluid interactive disk face 15. Also, and not limited thereto, the size and number of fluid driver elements 112 and fluid interactive elements 12 may also determine, at least in part, the heat output. Also, and not limited thereto, the number of rotation members 14 and stationary members 20 may also determine, at least in part, the heat output of the hydrodynamic heater 2.

The fluid inlet 34, the space between the fluid driver disk face 115 and the fluid interactive disk face 15, and the fluid outlet 36 define a fluid path (indicated by the arrows shown on FIG. 1). A working fluid having a lower temperature enters the fluid inlet 34, is acted upon by the interaction of the rotation member 14 and the stationary member 20 thereby heating the working fluid, and the working fluid having a higher temperature exits the housing cavity 32 through fluid outlet 36. Thus, as the rotation member 14 rotates, the fluid absorbs at least a portion of the heat generated by the shearing of the working fluid. The working fluid may thus be used to transport heat to another location.

In accordance with an embodiment, an external fluid path 132 external to the housing 30 is established between the fluid outlet 36 and the fluid inlet 34 such that the fluid circulates from the fluid outlet 36, through the external fluid path 132, into the fluid inlet 34, and through the fluid cavity 32, as shown in FIG. 1. The external fluid path 132 may be facilitated by any suitable conduit operable to control the transport of the working fluid, such as, but not limited to, pipe and hose. In accordance with embodiments, connectors couple a conduit to the fluid inlet 34 and the fluid outlet 36 so as to transfer the working fluid out of the hydrodynamic heater 2 so as to transfer the heat to an external location from the hydrodynamic heater 2.

The external fluid path 132 may include a heat exchanger 72 or other suitable apparatus operable to exchange heat to a target environment as will be discussed below. Such target environment may include, but not limited to, a fluid path of a fan so as to heat air, such as a grain dryer, and heat hoses to heat and defrost frozen ground onto which the hose is placed.

The radial and axial placement of the fluid driver elements 112 and the fluid interactive elements 12 about the fluid driver disk face 115 and the fluid interactive disk face 15, respectively, as shown in FIGS. 2 and 3 is exemplary only. Placement of the fluid driver elements 112 and the fluid interactive elements 12 about the disk-shaped member 22 in other arrangements, orientations, spacing, among other things, in planar relationship or otherwise, is anticipated suitable for a particular purpose of imparting shear to a working fluid so as to induce heating within the working fluid. Furthermore, the fluid driver elements 112 and the fluid interactive elements 12 need not be of the same size, shape, or orientation, among other things.

In accordance with the embodiment of FIG. 1, the rotation member 14 is caused to rotate about the X-axis while the stationary member 20 is held stationary. It is understood that relative motion between the stationary member 20 and the rotation member 14 can be produced, in accordance with embodiments, by the above mentioned configurations, and by other configurations, such as, but not limited to, rotation of both the stationary member 20 and rotation member 14 at different rates in the same direction, and rotation of both the stationary member 20 and rotation member 14 in opposite directions.

The rate of heat generation in the hydrodynamic heater 2 in accordance with embodiments depends, at least in part, on the hydrodynamic properties of the stationary member 20 and the rotation member 14 as well as the relative rotation speed between the two.

Therefore, for applications wherein a high rate of heat generation is desirable, it may be desirable that the rotation member 14 have a relatively high relative rotation speed with respect to the stationary member 20. The degree of fluid shear produced by the fluid driver elements 112 and the fluid interactive elements 12 is related to the relative rotation speed.

In addition, the maximum temperature that can be generated by a hydrodynamic heater 2 according to embodiments herein, depends, at least in part, on the heat capacity of the fluid 12.

The rotation member 14 comprises any material suitable for the particular purpose. Suitable materials include, but are not limited to, copper, aluminum, alloys of copper, alloys of aluminum, and other metallic or non-metallic materials.

FIG. 1 shows the hydrodynamic heater 2 in simplified schematic form for clarity. It is understood that additional structure may be present to provide structural support for containment and alignment of the stationary member 20, rotation member 14, and shaft 18. By way of example, but not by way of limitation, a fluid seal between the shaft 18 and the housing 30 may be required to contain the fluid from leaking though the penetration of the housing 30 to accommodate the shaft 18. Also, but not by way of limitation, the stationary member 20 may be supported by structure within the housing 30 to ensure alignment with the rotation member 14.

Again referring to FIG. 1 of the hydrodynamic heater 2, the fluid path 16 is defined so that at least a portion thereof extends between the fluid interactive disk face 15 of the stationary member 20 and the fluid driver disk face 115 of the rotation member 14 in accordance with embodiments. The fluid path 16 extends substantially parallel with respect to the fluid driver disk face 115 and the fluid interactive disk face 15.

Suitable working fluids for the particular purpose include, but are not limited to, liquid fluids such as water, propylene glycol, among others.

Figure 4:
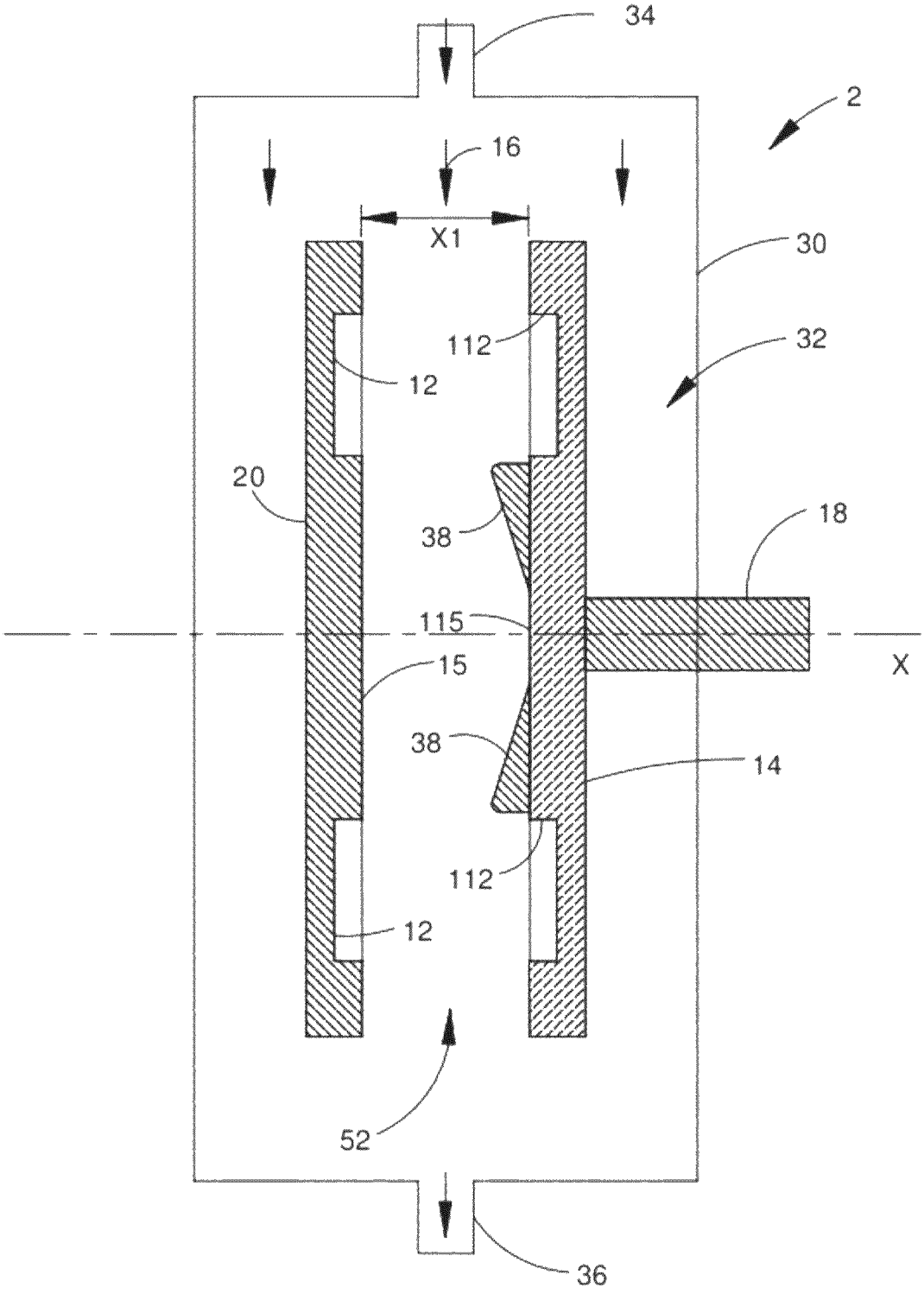
FIG. 4 is a side view of another embodiment of a hydrodynamic heater further comprising a rotation member comprising fluid movement elements.

FIG. 4 is a side view of another embodiment of a hydrodynamic heater 2 further comprising a rotation member 14 comprising fluid movement elements 38, in this embodiment, in the form of fins, depending from the fluid driver disk face 115 operable to engage with a fluid for driving fluid through the fluid cavity 32. The fluid movement elements 38 comprise a plurality of fins or blades. The driving action of the fluid is provided by the rotation of the rotation member 14 with the fins moving the fluid. Thus, the speed of operation of the fluid movement elements 38 depends on the speed of motion of the rotation member 14, and likewise the rate of fluid flow within the fluid path 16. In this embodiment, the fluid driver elements 112 are operable to produce the fluid shear while the fluid movement elements 38 move the fluid through the fluid cavity 32.

In accordance with another embodiment, fluid movement elements 38 are also operable to induce fluid shear in the working fluid. In yet other embodiments, fluid movement elements 38 in the form of fins disposed on the fluid interactive disk face 15 of the stationary member 20 induces fluid shear as the working fluid is driven past the fluid interactive disk face 15 by the rotation member 14.

In accordance with other embodiments, the working fluid is driven through the flow path by an external energy source, such as, but not limited to, a pump.

It is appreciated that the temperature to which working fluid passing through the fluid path 16 is heated depends, at least in part, on the rate of rotation of the rotation member 14 and the amount of fluid shear produced. Also, the temperature of the fluid depends, at least in part, on the rate at which the fluid moves through the fluid path 16, that is, on how long the fluid is undergoing fluid shear. Further, the temperature of the fluid depends, at least in part, on the efficiency of the fluid driver elements 112 and the fluid interactive elements 12 to produce fluid shear so as to induce heating of the fluid.

The performance parameters, such as, but not limited to, the rate of heat generation, rate of fluid flow, and fluid temperature, may be independent of one another as described in some embodiments herein. A hydrodynamic heater 2 in accordance with embodiments may be used to produce a specific temperature of working fluid in combination with a specific rate of fluid flow. Any two of the three parameters may be controlled independently of one another in accordance with at least some embodiments disclosed herein.

The energy source used to drive the rotation of the shaft 18 may comprise any suitable means. In accordance to embodiments, the shaft 18 may be operable to be coupled to a power take-off found on some motor vehicles, such as, but not limited to, many tractors, other agricultural vehicles, and heavy work vehicles. In such vehicles, some of the mechanical driving force generated by an engine is transferred to the power take-off to impart rotation, such as to the shaft 18. Conventional power take-offs include a rotatable coupling or other movable component which may be engaged with a linkage to impart rotation to the shaft 18.

In other embodiments, the shaft 18 comprises a hydraulic linkage. Certain vehicles include hydraulic systems, such as, but not limited to, for actuating a snow plow or shovel blade, for tipping a truck bed, or for operating a fork lift. The hydraulic system may be operable to couple with supplemental equipment, such as a hydraulic motor, with suitable linkage operable to couple with the shaft 18, to provide power thereto. Hydraulic systems and hydraulic linkages are known in the art, and are not described in detail herein.

Various embodiments are anticipated so as to control the rate of heat output of the hydrodynamic heater 2. In accordance with embodiments, the temperature change of the working fluid within the hydrodynamic heater 2 is directly related to the heat energy (BTU) generated in the working fluid and the flow rate of the working fluid. Adjusting one or both of the heat energy (BTU) generated in the working fluid and the flow rate provides a predetermined amount of fluid with a predetermined temperate exiting the hydrodynamic heater 2.

Figure 5:
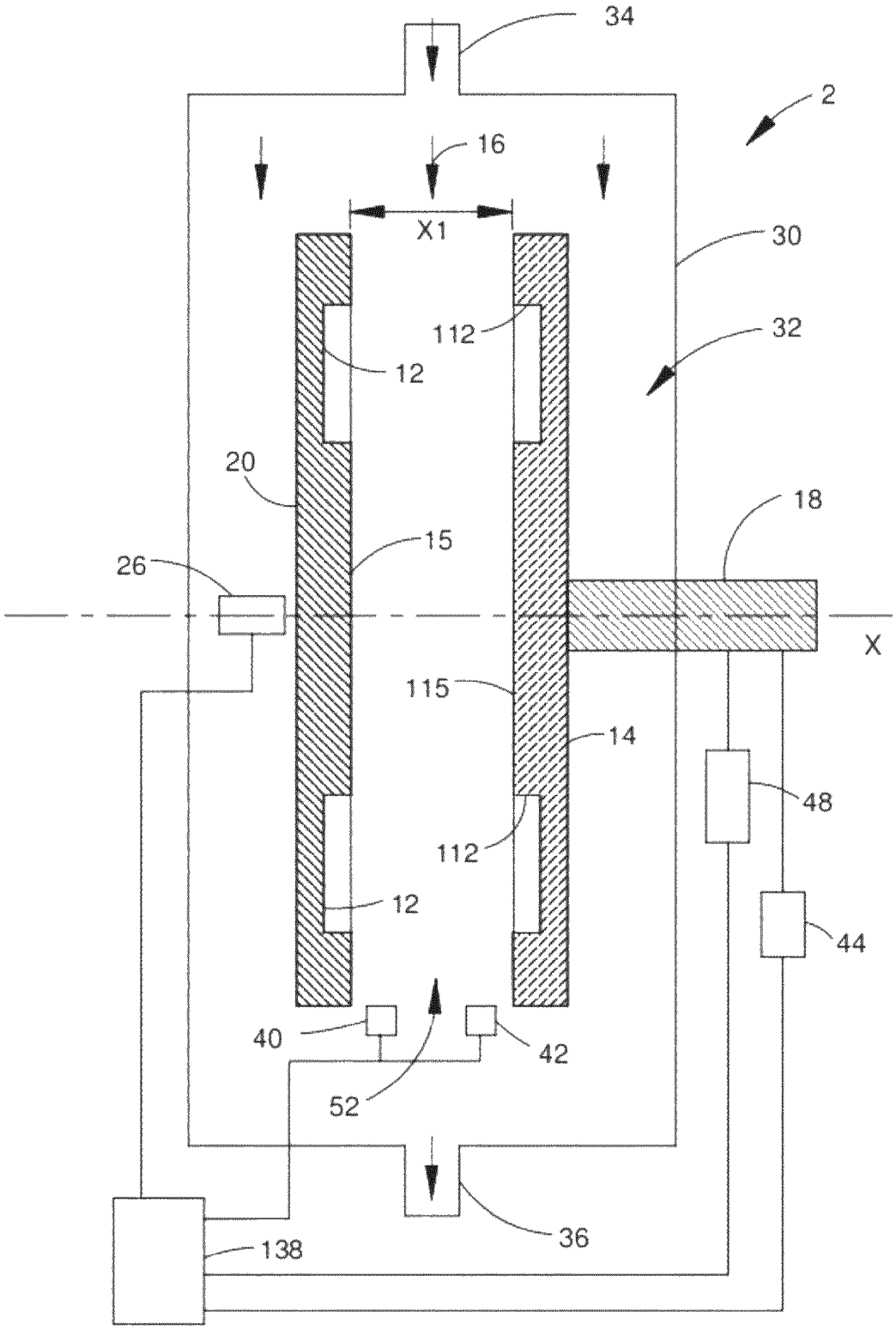
FIG. 5 is a side cross-sectional view of the hydrodynamic heater of FIG. 1, further comprising a first spacing actuator coupled to the stationary member operable to translate the stationary member along the X-axis for varying the spacing between the fluid driver disk face and the fluid interactive disk face, in accordance with an embodiment.

FIG. 5 is a side cross-sectional view of the hydrodynamic heater 2 of FIG. 1, further comprising a first spacing actuator 26 coupled to the stationary member 20 operable to translate the stationary member 20 along the X-axis for varying the spacing X1 between the fluid driver disk face 115 and the fluid interactive disk face 15, in accordance with an embodiment. In contrast to the embodiment of FIG. 4 wherein the spacing X1 between the stationary member 20 and the rotation member 14 is fixed, the spacing X1 is variable in the embodiment of FIG. 5, wherein the spacing X1 may be changed either during operation or when not in operation. During operation, when the spacing X1 is reduced, fluid shear will increase and thus the temperature of working fluid will increase, and as the spacing X1 is increased, fluid shear will decrease and thus the temperature of working fluid will decrease.

In accordance with another embodiment, the hydrodynamic heater 2 further comprises a second spacing actuator 44 coupled to the rotation member 14 operable to translate the rotation member 14 along the X-axis for varying the spacing X1 between the fluid driver disk face 115 and the fluid interactive disk face 15, as shown in FIG. 5. The spacing actuator 44 varies the spacing X1 between the fluid driver disk face 115 and the fluid interactive disk face 15 along the X-axis.

It is anticipated that the first spacing actuator 26 and the second spacing actuator 44 may be used in combination to vary the spacing X1 between the fluid driver disk face 115 and the fluid interactive disk face 15 along the X-axis.

The degree of fluid interaction with the fluid driver elements 112 and the fluid interactive elements 12 depends, at least in part, on the spacing X1 between the fluid driver disk face 115 and the fluid interactive disk face 15. A change in the spacing X1 between the fluid driver disk face 115 and fluid interactive disk face 15 changes the degree of fluid shear, and thus the rate at which heat is generated in the working fluid.

Reducing the spacing X1 between the fluid driver disk face 115 and fluid interactive disk face 15 increases the degree of fluid interaction between the fluid driver elements 112 and the fluid interactive elements 12, thus increasing the fluid shear and thus heating of the fluid. Increasing the spacing X1 between the fluid driver disk face 115 and fluid interactive disk face 15 reduces the degree of fluid shear by the fluid driver elements 112 and the fluid interactive elements 12, thus reducing the heating of the rotation member 14.

In embodiments wherein it is desirable to enable a high range of variability in the rate of heat generation, it is desirable that the range of possible values for the spacing X1 between the fluid driver disk face 115 and fluid interactive disk face 15 be relatively large.

The spacing X1 between the fluid driver disk face 115 and fluid interactive disk face 15 is a parameter that is independent of the rate of fluid flow through the fluid interaction space 52 and the rate of rotation of the rotation member 14. Thus, the rate of heat generation of the hydrodynamic heater 2 is adjustable by varying the spacing X1 without changing the rate of rotation of the rotation member 14.

In accordance with an embodiment, the rate of heat generation of the hydrodynamic heater 2 is adjustable by controlling one or more of the rate of rotation of the shaft 18, the spacing X1, and the rate of fluid flow through the fluid interaction space 52. In an embodiment, the spacing actuator 26 is used to facilitate adjustment of the spacing X1 while the hydrodynamic heater 2 is generating heat.

A variety of actuators are suitable for use as the first spacing actuator 26 and the second spacing actuator 44. In an embodiment, as illustrated in FIG. 5, the spacing actuator 26 is a linear actuator engaged with the stationary member 20 to move it toward or away from the rotation member 14, thereby adjusting the spacing from X1.

In an embodiment, the spacing actuator 26 is a manual actuator, such as, but not limited to, a threaded screw controlled by a hand-turned knob. In other embodiments, the spacing actuator 26 is a powered actuator, such as, but not limited to, an electrically or hydraulically driven mechanism. In accordance with another embodiment, one or both of the stationary member 20 and rotation member 14 may be coupled to a shaft comprising helical thread, wherein the location of the stationary member 20 and rotation member 14 on the shaft, and thus the spacing X1 between the stationary member 20 and the rotation member 14 may be changed.

Referring again to FIG. 5, the hydrodynamic heater 2 further comprises a controller 138. The controller 138 is in communication with the first spacing actuator 26 and the second spacing actuator 44 so as to control the spacing X1. The controller 138 may also be in communication with the shaft 18, so as, by way of example, but not limited thereto, to control the speed of rotation of the rotation member 14, and therefore, the fluid driver elements 112, which derive their motion from the shaft 18, wherein the output of the motive device driving the shaft 18 is variable and controllable.

The controller 138 in FIG. 5 may thus control the rate of heat generation by controlling the spacing X1, and may also control the speed of rotation of the rotation member 14. By controlling these two parameters independently the temperature of the working fluid may also be controlled as described previously.

A variety of devices are suitable for use as a controller 138, including, but not limited to, microprocessor-based controllers. Controllers are known in the art and are not described further herein.

It is appreciated that the heat output may be controlled is a variety of ways. By way of example, but not limited thereto, the fluid flow of the working fluid through the hydrodynamic heater 2 and the speed of the rotation member 14 may be increased or decreased suitable for producing a particular heat output. By way of example, a decreased fluid flow in combination with a decreased speed of rotation of the rotation member 14 may maintain a predetermined temperature at the output 36.

Although the embodiment in FIG. 5 shows the controller 38 in communication with various sensors, such as, but not limited to, temperature sensor 40, fluid flow rate sensor 42, and drive speed sensor 48, it is emphasized that this is exemplary only. In other embodiments, the controller 138 controls the operation of the hydrodynamic heater 2 without sensors or data therefrom. In embodiments, the controller 138 comprises stored data and/or a pre-calculated algorithm, based on, among other things, the design of the hydrodynamic heater 2 and the performance of similar hydrodynamic heaters 2. The controller 138 may control the hydrodynamic heater 2 to produce the desired level of heat generation, working fluid temperature, and/or rate of fluid flow, without the need for active sensors to monitor the parameters of the hydrodynamic heater 2.

The embodiment in FIG. 5 includes a fluid temperature sensor 40 for sensing the temperature of working fluid moving along the fluid path 16. It also includes a fluid flow rate sensor 42 for sensing the rate of fluid flow through the fluid path 16. It further includes a drive speed sensor 48 for sensing the rate at which the rotation member 14 is rotated by the shaft 18. The controller 138 is in communication with each of the fluid temperature sensor 40, fluid flow rate sensor 42, and drive speed sensor 48.

Based on data from the fluid temperature sensor 40, fluid flow rate sensor 42, and drive speed sensor 48, the controller 138 may adjust the speed of the rotation member 14, the speed of the fluid driver 34, and/or the spacing X1, so as to control heat generation, working fluid temperature, and/or fluid flow.

It is emphasized that the arrangement of the fluid temperature sensor 40, fluid flow rate sensor 42, and drive speed sensor 48, as shown, is exemplary only. It is not necessary for a particular embodiment to include sensors at all, or to include each of the fluid temperature sensor 40, fluid flow rate sensor 42, and drive speed sensor 48, shown in FIG. 5. In other embodiments, other sensors are included in the hydrodynamic heater 2 in addition to or in place of those shown.

In an embodiment, the hydrodynamic heater 2 comprises an additional sensor operable to sense the spacing X1 between the stationary member 20 and the rotation member 14.

A variety of sensors are suitable for use in a hydrodynamic heater 2 according to embodiments, depending upon the particulars of the specific embodiment of the hydrodynamic heater 2 and the type of information that is to be sensed. Sensors are known in the art and are not described further herein.

Figure 6:
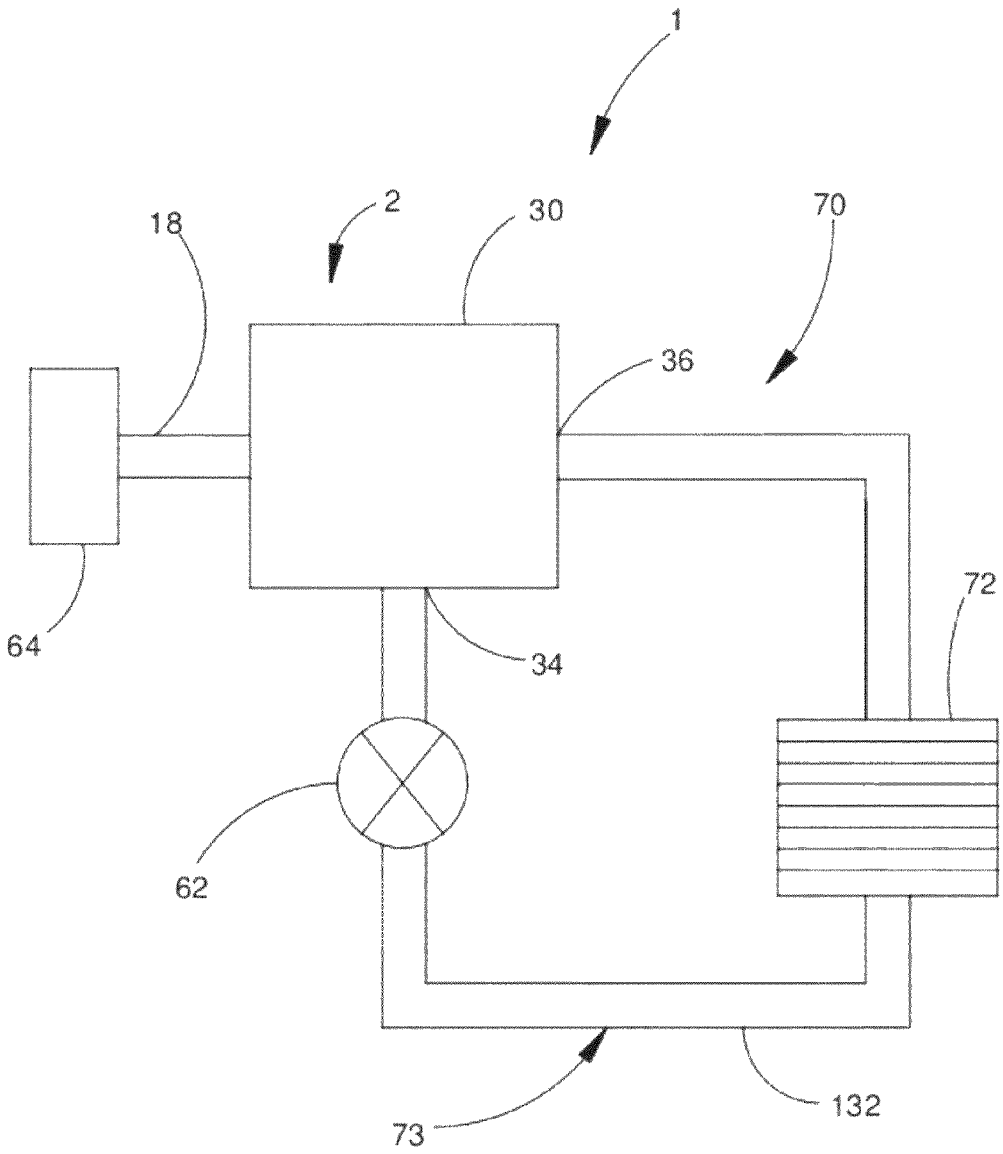
FIG. 6 is a schematic representation of an embodiment of a heater system comprising a hydrodynamic heater, a fluid handling system, and a motor drive.

FIG. 6 is a schematic representation of an embodiment of a heater system 1 comprising a hydrodynamic heater 2, a fluid handling system 70, and a motor drive 64. The fluid handling system 70 comprises a pump 62 and a heat exchanger 72 coupled to the hydrodynamic heater 2 via plumbing 73. The pump 62 is operable to circulate fluid through the hydrodynamic heater 2 and the heat exchanger 72. The pump drives the fluid through the fluid inlet 34 through the hydrodynamic heater 2 and through the outlet 36 to the fluid handling system 70, through the heat exchanger 72 to exchange heat with a target environment, and back to the pump 62 to complete the cycle.

The motor drive 64 is coupled to the shaft 18 of the hydrodynamic heater 2 operable to rotate the rotation member 14 within the hydrodynamic heater 2 and therefore heat the working fluid circulating through the hydrodynamic heater 2.

The fluid handling system 70, which includes the external fluid path 132 external to the housing 30, includes the heat exchanger 72 operable to heat a target environment. Such target environment may include, but not limited to, a fluid path of a fan so as to heat air, such as a grain dryer, and liquid hoses to heat and defrost frozen ground under which the hose is placed.

Figure 7:
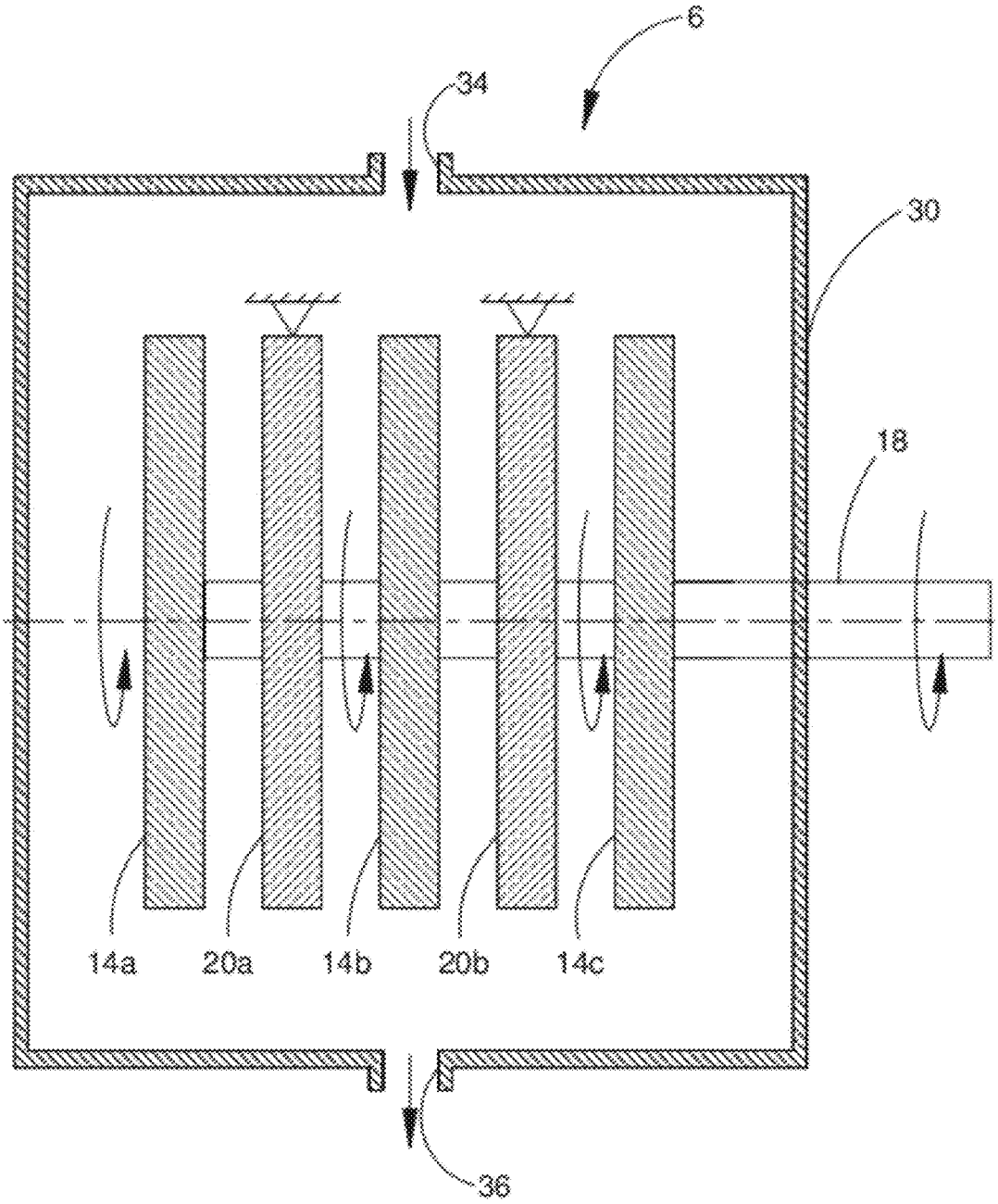
FIG. 7 is a side cross-sectional view of an embodiment of a multi-stage hydrodynamic heater.

FIG. 7 is a side cross-sectional view of an embodiment of a multi-stage hydrodynamic heater 6. The embodiment shown in FIG. 1 has one pair of rotation member 14 and stationary member 20. Embodiments of hydrodynamic heater 2 may be scaled by the use of additional rotation members 14 and stationary members 20. The embodiment of FIG. 7 comprises an arrangement with three rotation members 14*a-c* and two stationary members 20*a,b*. It is noted that the number of rotation members 14 and stationary members 20 is exemplary only, and that other numbers and arrangements may be suitable for a particular purpose. It is also appreciated that each stationary member 20 may comprise a first disk-shaped member 22 having a plurality of fluid interactive elements 12 on each of the two sides of the stationary member 20, and that each rotation member 14 may comprise a second disk-shaped member 122 having a plurality of fluid driver elements 112 on each of the two sides of the rotation member 14.

It is appreciated that heat output may be controlled by selective activation and deactivation (rotation or stationary) of individual rotation members 14.

Figure 8:
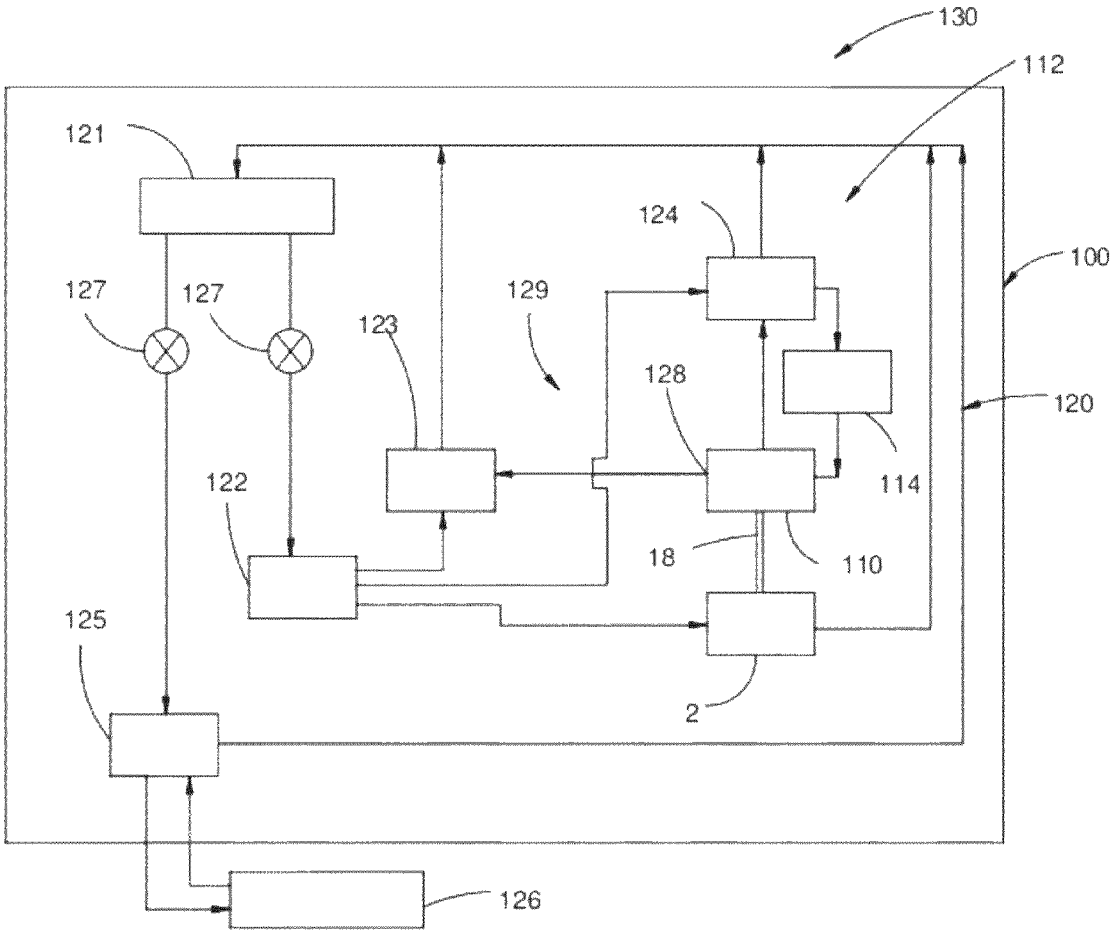
FIG. 8 is a schematic diagram of an engine-driven heat generation system, in accordance with an embodiment.

FIG. 8 is a schematic diagram of an engine-driven heat generation system 100, in accordance with an embodiment. The engine-driven heat generation system 100 provides heat to external applications via a working fluid supplied to a suitable external heat exchanger 126 as described below. The engine-driven heat generation system 100 comprises an internal combustion engine 110, a hydrodynamic heater 2, such as, but not limited to, the embodiment of FIG. 1, and a fluid handling system 130. A driveshaft 18 from the engine 110 rotates the fluid driver element within the hydrodynamic heater 2 which in turn heats the working fluid.

The fluid handling system 130 comprises a working fluid handling system 120, an engine cooling system 112, and an exhaust system 129. The working fluid handling system 120 comprises a fluid reservoir 121, a manifold flow control 122, an exhaust heat exchanger 123, a coolant heat exchanger 124, and one or more circulating pumps 127, all in fluid communication operable to circulate the working fluid therein. The manifold flow control 122 is operable to direct the working fluid to the hydrodynamic heater 2, the exhaust heat exchanger 123, and the coolant heat exchanger 124.

The heat generated by the hydrodynamic heater 2 is transferred to the working fluid passing within the hydrodynamic heater 2. The working fluid is collected in the fluid reservoir 121 and either directed again through the manifold flow control 122 or directed to an external heat exchanger 126 by way of an external manifold 125, or a combination thereof. The external manifold 125 is operable to provide one or more fluid take-offs to supply the heated working fluid and return cooled working fluid to/from one or more external heat exchangers 126.

The engine cooling system 112 comprises a coolant reservoir 114 for a coolant fluid in fluid communication with the engine 110 and the coolant heat exchanger 124. The coolant fluid circulates within the engine 110, wherein the heat from the structure of the engine 110 is transferred to the coolant fluid and subsequently transferred to the working fluid in the coolant heat exchanger 124. In this way, the heat from the engine 110 as well as the heat from the hydrodynamic heater 2 is used to heat the working fluid.

The engine 110 produces hot exhaust gas as a product of combustion which is directed external to the engine 110 by an exhaust manifold 128. The exhaust system 129 comprises the exhaust heat exchanger 123 which is in fluid communication with the exhaust manifold 128 and is operable to transfer the heat from the exhaust of the engine 110 to the working fluid. In this way, the heat from the exhaust as well as the heat from the hydrodynamic heater 2 and engine cooling system 112 is used to heat the working fluid.

The engine-driven heat generation system 100, therefore, utilizes the heat of the structure of the engine 110 and the heat from the exhaust of the engine 110 to augment the heat from the hydrodynamic heater 2 to efficiently provide a heated working fluid to the external heat exchanger 126.

Figure 9:
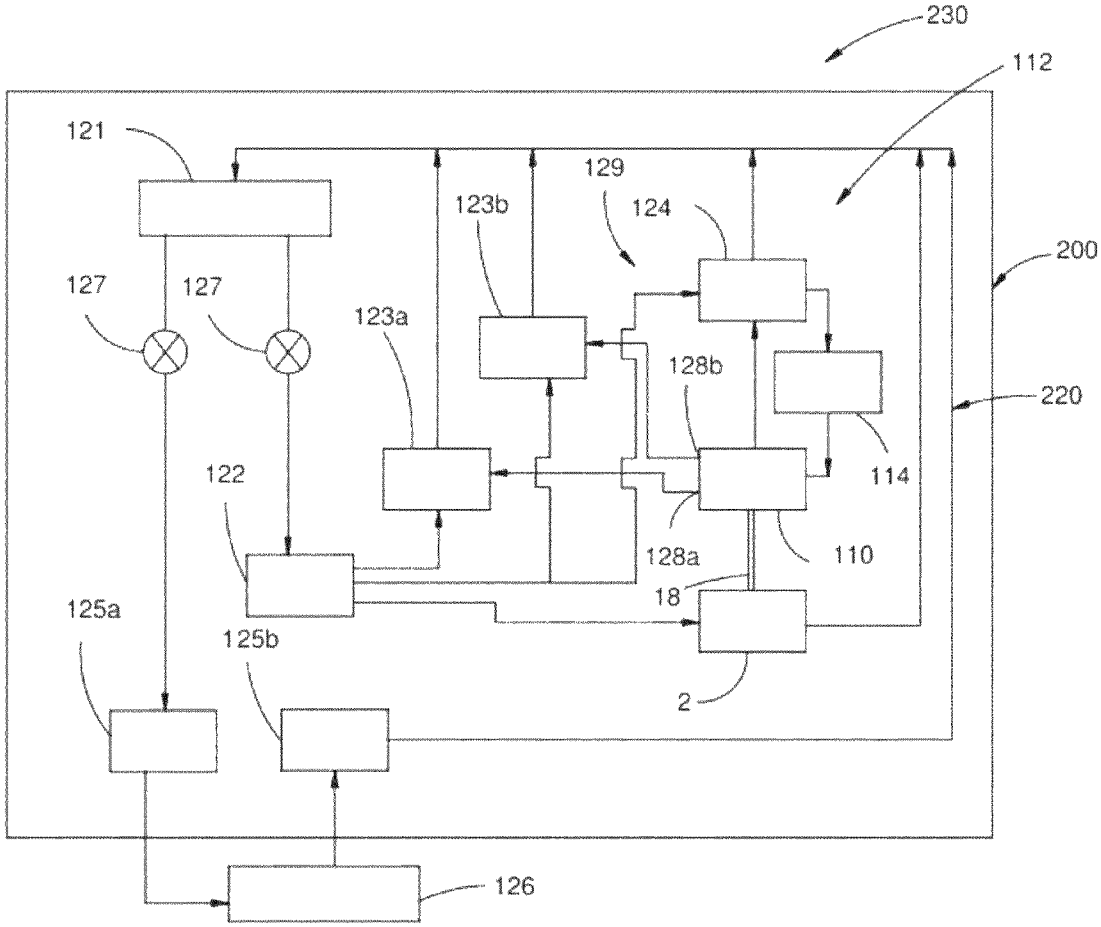
FIG. 9 is a schematic diagram of another engine-driven heat generation system, in accordance with another embodiment.

It is appreciated that a variety of configurations of an engine-driven heat generation system may be utilized, depending on engineering design preferences and constraints. FIG. 9 is a schematic diagram of another engine-driven heat generation system 200, in accordance with another embodiment. The engine-driven heat generation system 200 comprises an internal combustion engine 110, a hydrodynamic heater 2, such as, but not limited to, the embodiment of FIG. 1, and a fluid handling system 230. The configuration and function is substantially similar to the embodiment of FIG. 8, but this embodiment comprises an engine 110 having two exhaust manifolds 128*a*, 128*b*, two exhaust heat exchangers 123*a*, 123*b* in fluid communication with respective exhaust manifolds 128*a*, 128*b*, and separate external manifolds, a supply manifold 125*a* and a return manifold 125*b*.

The applications for utilizing the heat generated by the engine-driven heat generation system 100, 200 are vast. The working fluid is heated to a predetermined temperature suitable for a particular purpose. It is anticipated that most any application that utilizes the transfer of heat via a heat exchanger supplied by a heated working fluid would be suitable for use with the engine-driven heat generation system 100, 200.

In an embodiment, the heated working fluid is passed through a heat exchanger that is part of a forced-air ventilation system to provide heated air to a building. In another embodiment, the working fluid is passed through hoses that are laid out on the ground and covered with a covering so as to heat the ground, such as to thaw out frozen ground for excavation. In yet another application, the working fluid is passed through a heat exchanger of a hot water supply system that is submerged in a tank of water so as to heat the water for use. These are but a few of the vast number of applications suitable for use with the engine-driven heat generation system 100, 200.

The engine-driven heat generation system 100, 200 realizes significantly improved efficiencies over conventional hydrodynamic heaters by the utilization of the heat captured from the engine exhaust and the heat captured from the engine cooling system that are added to the heat generated by the hydrodynamic heater.

Figure 10:
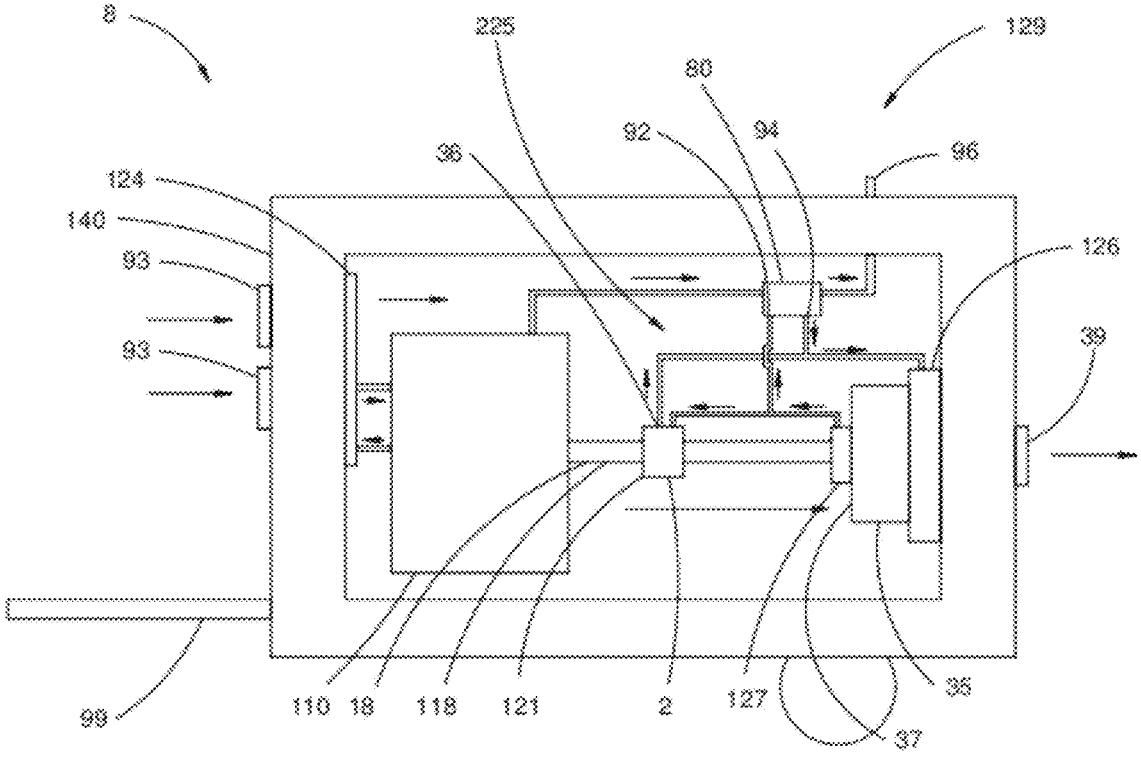
FIG. 10 is a side perspective view of a heating system in accordance with an embodiment.
Figure 11:
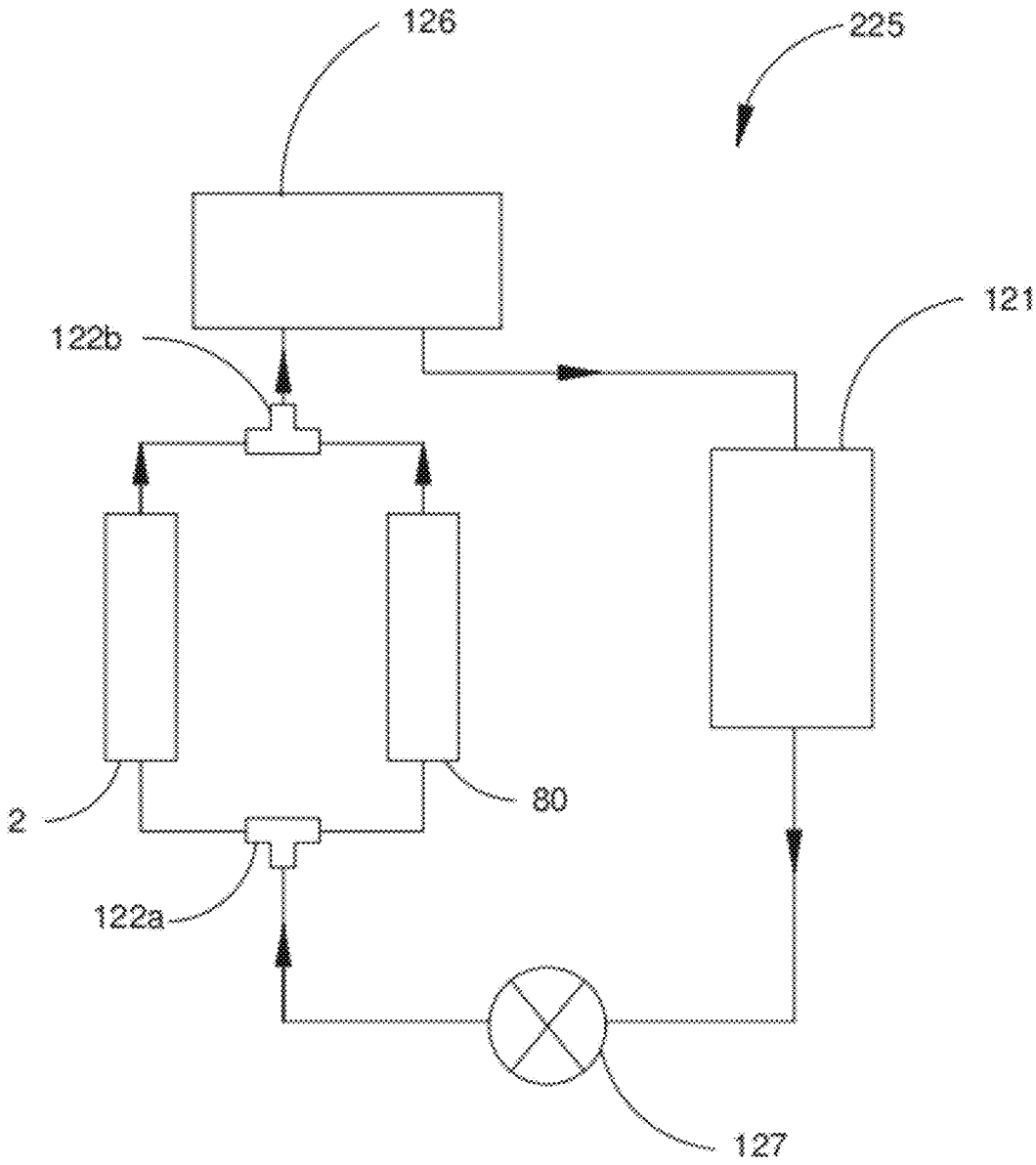
FIG. 11 is a schematic of the fluid handling system associated with the heating system of FIG. 10.

FIG. 10 is a side perspective view of a heating system 8 in accordance with an embodiment. FIG. 11 is a schematic of the fluid handling system 225 associated with the heating system 8 of FIG. 10. The heating system 8 is operable for providing heated air suitable for a particular purpose, such as, but not limited to, heating the interior of a building and drying grain.

The heating system 8 comprises an internal combustion engine 110, an air handling system 35, and a hydrodynamic heater 2, all contained in an enclosure 140 on a trailer 99. The air handling system 35 is operable to draw in air external to the enclosure 140 via to air intakes 93, and exhaust air out of the enclosure 140 via an air outlet 39.

The internal combustion engine 110 is coupled to an engine cooling system 112. The engine cooling system 112 comprises a coolant reservoir (not shown) for a coolant fluid in fluid communication with the engine 110 and a coolant heat exchanger 124. The coolant fluid circulates within the engine 110, wherein the heat from the structure of the engine 110 is transferred to the coolant fluid and subsequently transferred to the working fluid in the coolant heat exchanger 124.

The engine 110 produces hot exhaust gas as a product of combustion which is directed external to the engine 110 by an exhaust manifold (not shown). The exhaust system 129 comprises the exhaust heat exchanger 80 which is in fluid communication with the exhaust manifold (not shown) and is operable to transfer the heat from the exhaust of the engine 110 to the working fluid.

An engine drive shaft 118 is coupled to the shaft 18 of the hydrodynamic heater 2 operable to rotate the rotation member 14 within the hydrodynamic heater 2 and therefore heat the working fluid circulating through the hydrodynamic heater 2.

The working fluid circulates through the fluid handling system 225 as represented in FIG. 11. The fluid handling system 225 comprises a reservoir 121, a pump 127, an exhaust heat exchanger 80, coupling for the hydrodynamic heater 2, and an air heat exchanger 126. The fluid handling system 225 provides a circulatory loop therethrough. Referring to FIG. 11, the working fluid is drawn from a reservoir 121 by a pump 127. The pump 127 is coupled to a splitting manifold 122*a* that is in fluid communication with fluid inlets of the hydrodynamic heater 2 and the exhaust heat exchanger 80. The working fluid is heated within the hydrodynamic heater 2 and the exhaust heat exchanger 80. The heated fluid is recombined by a second manifold 122*b* that is in fluid communication with the fluid outlets of the hydrodynamic heater 2 and the exhaust heat exchanger 80. The working fluid is supplied to an air heat exchanger 126 that is operable to exchange heat with an air flow. The working fluid is returned to the reservoir 121.

Referring to FIG. 10, the air handling system 35 comprises a blower. The air handling system 35 is operable to draw in air from the intakes 93 through the coolant heat exchanger 124 such that the air absorbs heat from the coolant heat exchanger 124. The air is drawn into a blower inlet 37 with the air exhausted through the air heat exchanger 126 and the blower outlet 39 such that the air absorbs heat from the air heat exchanger 126. The blower outlet 39 may be provided with suitable conduit to direct the heated air for a particular purpose.

Heat from the engine exhaust, via the exhaust heat exchanger 80 and heat from the hydrodynamic heater 2, as well as heat from the engine cooling system 112 via the coolant heat exchanger 124, is used to heat air driven by the air handling system 35.

It is appreciated that air may also pass by the parts of the engine 110 that are at elevated temperature picking up heat before reaching the air heat exchanger 126, and therefore contribute to the overall heat output of the heating system 8.

The trailer 99 is operable to transport the heating system 8. The trailer 99 is operable to be hitched to a vehicle for movement from location to location.

It is appreciated that the heating of the air is dependent in part on the speed of rotation of the driveshaft from the engine 110 driving the rotation member 14 within the hydrodynamic heater 2. Since the embodiment of FIG. 10 also utilizes heat obtained from the engine 110 by way of the engine cooling system 112 and the exhaust system 129, as the driveshaft speed is increased, the heat rejected by the engine, and thus available to heat the air will also increase.

In accordance with an embodiment, the heater system 8 further comprises a temperature controller. The temperature controller comprises a temperature sensor that is operable to monitor either the output air at the blower outlet 39 or the ambient air in the space being heated by the air coming from the blower outlet 39. An operator may input a desired temperature output or ambient temperature and the controller is operable to determine a suitable engine speed operable to maintain the operator desired temperature.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the art will readily appreciate that the present invention may be implemented in a very wide variety of embodiments. This application is intended to cover any adaptations or variations of the embodiments discussed herein.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and appended claims contained.

I claim:

1. An engine-driven heat generation system comprising:

an internal combustion engine having a drive shaft defining an axis;

a hydrodynamic heater comprising:

a stationary member; and a rotation member disposed proximate the stationary member with a working fluid therebetween, wherein rotation of the rotation member about an X-axis induces shear within the working fluid operable to increase the temperature of the working fluid; and a fluid handling system, the drive shaft of the engine adapted to rotate the rotation member within the hydrodynamic heater which in turn heats the working fluid flowing within a fluid path of the hydrodynamic heater, the fluid handling system comprising:

a fluid reservoir;

a manifold flow control adapted to direct fluid to the fluid path of the hydrodynamic heater;

an exhaust heat exchanger; and a coolant heat exchanger, wherein heat from the exhaust of the engine is transferred to the fluid in the exhaust heat exchanger, heat from an engine cooling system, which comprises a coolant reservoir, is transferred to the fluid in the coolant heat exchanger, heat generated by the hydrodynamic heater is transferred to the working fluid passing within the hydrodynamic heater, the working fluid is recollected in the fluid reservoir and either directed again through the manifold flow control or directed to an external heat exchanger by way of an external manifold, the external manifold is adapted to provide fluid take-offs to supply heated fluid and return cooled fluid to/from the external heat exchanger.

2. The engine-driven heat generation system of claim 1, wherein the stationary member comprises a disk-shaped member having a plurality of fluid interactive elements, the plurality of fluid interactive elements being disposed and arranged in a planar, generally circular, spaced-apart, orientation on the disk-shaped member defining a fluid interactive disk face, the rotation member comprising a shaft and a disk-shaped member having a plurality of fluid driver elements, the plurality of fluid driver elements being disposed and arranged in a planar, generally circular, spaced-apart, orientation on the disk-shaped member defining a fluid driver disk face, the shaft being coupled substantially at the center of rotation of the disk-shaped member, the shaft being operable to couple with an energy source capable of imparting rotation to the shaft so as to rotate the rotation member about the X-axis, the fluid driver disk face of the rotation member being disposed in opposing, substantially parallel, spaced-apart relationship with the fluid interactive disk face of the stationary member.

3. The hydrodynamic heater of claim 1, wherein the distance of separation between the fluid driver disk face and the fluid interactive disk face is operable to be changed during operation.

4. The engine-driven heat generation system of claim 1, wherein stationary member comprises one or more fluid interactive elements being operable to cooperate with the one or more fluid driver elements so as to induce fluid movement operable to heat the fluid therebetween.

5. The hydrodynamic heater of claim 1, wherein the rotation member further comprises fluid movement elements depending from the fluid driver disk face operable to engage with the working fluid for driving the working fluid through the housing.

6. The hydrodynamic heater of claim 1, further comprising:

a plurality of stationary members; and a plurality of rotation members disposed in alternating arrangement and proximate the stationary members with a working fluid therebetween, wherein rotation of the rotation members about the X-axis induces fluid shear within the working fluid operable to increase the temperature of the working fluid.

* * * * *